US006964357B2

(12) United States Patent
Manganini

(10) Patent No.: US 6,964,357 B2
(45) Date of Patent: Nov. 15, 2005

(54) STABLE UPRIGHT FLUID DISPENSING CONTAINERS

(76) Inventor: Steven James Manganini, 105 Braeside Rd., Falmouth, MA (US) 02540

( * ) Notice: Subject to any disclaimer, the term of this patent is extended or adjusted under 35 U.S.C. 154(b) by 59 days.

(21) Appl. No.: 10/334,859

(22) Filed: Dec. 30, 2002

(65) Prior Publication Data

US 2003/0197037 A1 Oct. 23, 2003

Related U.S. Application Data

(60) Provisional application No. 60/343,526, filed on Dec. 31, 2001.

(51) Int. Cl.[7] ..... G01F 11/00

(52) U.S. Cl. ..... 222/390; 222/192; 222/405

(58) Field of Search ..... 222/192, 386, 222/390, 405

(56) References Cited

U.S. PATENT DOCUMENTS 1,288,554 A * 12/1918 France ..... 222/390
1,336,390 A * 4/1920 Sargery et al. ..... 401/175
2,461,211 A * 2/1949 Guthrie ..... 222/326
2,540,511 A * 2/1951 Coleman ..... 222/320
3,420,417 A * 1/1969 Kardel ..... 222/390
5,025,960 A * 6/1991 Seager ..... 222/390
6,347,728 B1 * 2/2002 Apolloni et al. ..... 222/320

* cited by examiner

*Primary Examiner*—Joseph A. Kaufman

(57) ABSTRACT

A stable upright fluid dispensing container in which a fluid is dispensed from the top of the container while the container remains in an upright position. The bulk of the fluid always remains in the bottom of the container. A passageway tube and a plunger apply pressure on the fluid. Knobs on the plunger can include horizontal knob gears, vertical knob gears or push button rack gears. Pressure can also be applied to the fluid by a non-rotating threaded passageway tube having a fixed plunger and a rotating threaded knob. In flexible sealed containers pressure can be applied to the fluid by providing a flexible sealed container, a non-threaded passageway tube and one-way check valve. These features provide increased pressure such that the fluid will be forced to flow into a passageway tube through an entrance opening at the bottom of the passageway tube, up through the tube and out an exit opening. Further, once pressure is relaxed, the fluid flow will stop and the fluid will remain in the passageway tube. Thus, all the fluid in the container will be dispensed.

5 Claims, 7 Drawing Sheets

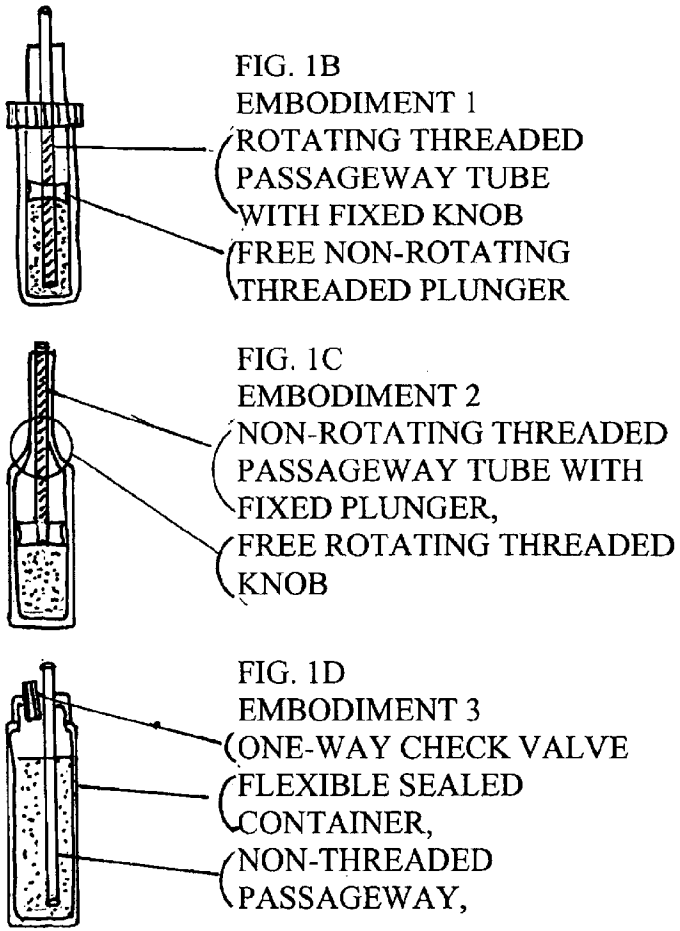
FIG. 1B
EMBODIMENT 1
ROTATING THREADED
PASSAGEWAY TUBE
WITH FIXED KNOB
FREE NON-ROTATING
THREADED PLUNGER
FIG. 1C
EMBODIMENT 2
NON-ROTATING THREADED
PASSAGEWAY TUBE WITH
FIXED PLUNGER,
FREE ROTATING THREADED
KNOB
FIG. 1D
EMBODIMENT 3
ONE-WAY CHECK VALVE
FLEXIBLE SEALED
CONTAINER,
NON-THREADED
PASSAGEWAY,

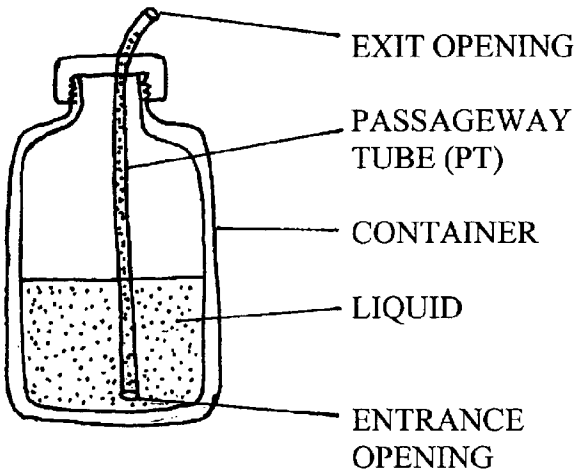
FIG. 1A
STABLE UPRIGHT FLUID
DISPENSING CONTAINER
CONCEPT
EXIT OPENING
PASSAGEWAY
TUBE (PT)
CONTAINER
LIQUID
ENTRANCE
OPENING FIG. 2A, 2B, 2C
EMBODIMENT 1, ROTATING THREADED
PASSAGEWAY TUBE WITH FIXED KNOB AND FREE
NON-ROTATING THREADED PLUNGER
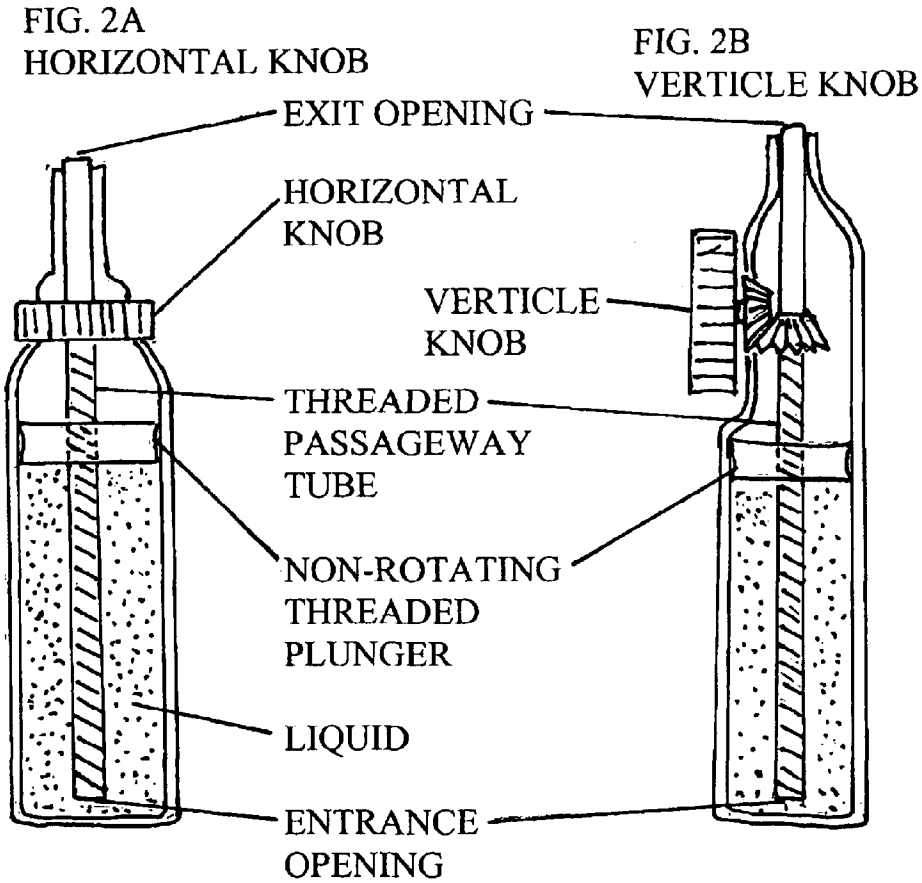
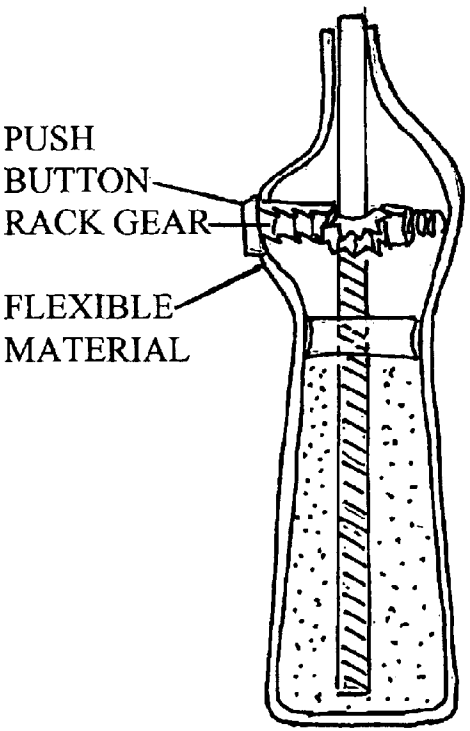

FIG. 3A, 3B, 3C,
EMBODIMENT 2
NON-ROTATING THREADED PASSAGEWAY TUBE WITH
FIXED PLUNGER, FREE ROTATING THREADED KNOB
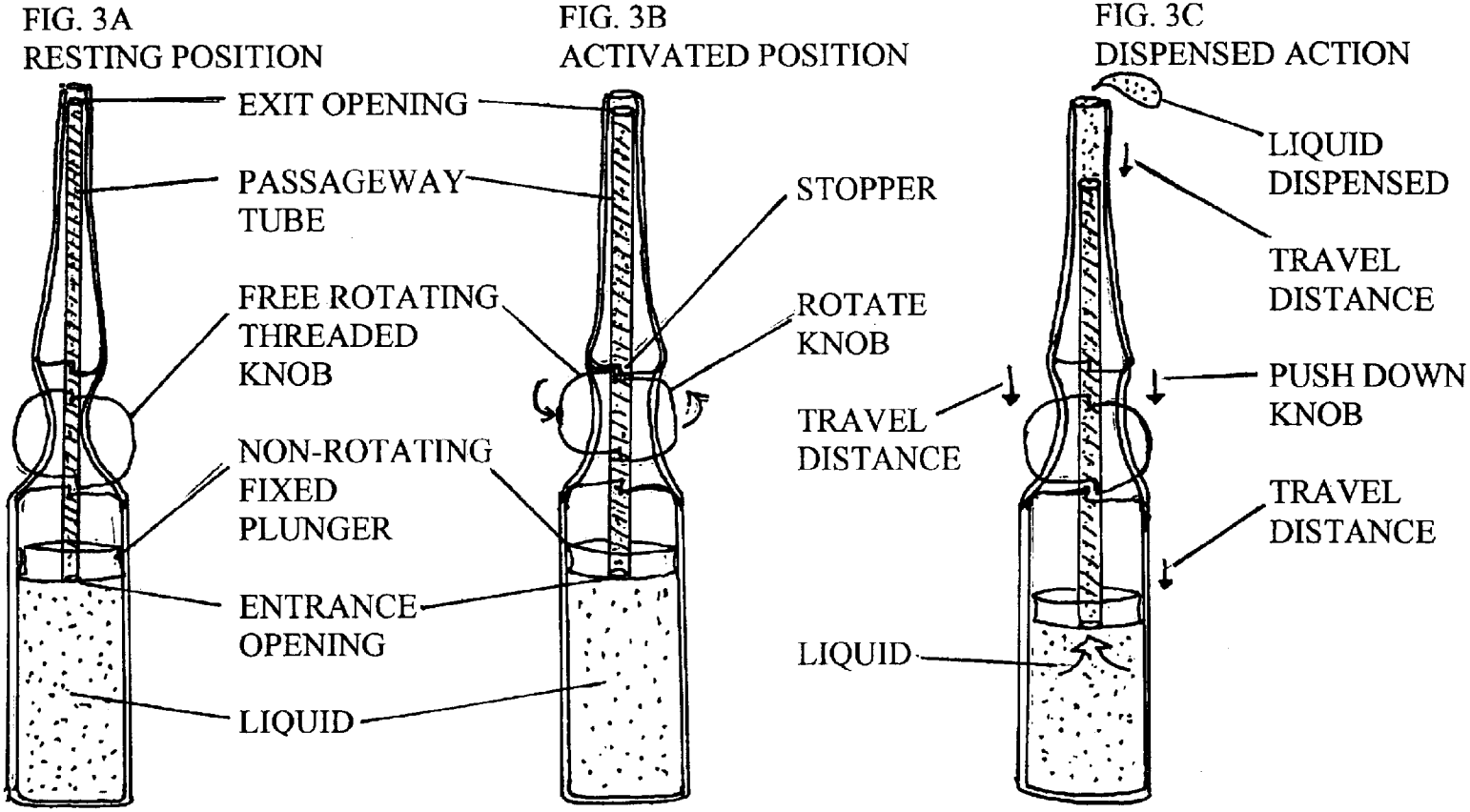

TOOTHBUDDY
SIDE VIEW

BRUSH HEAD
FRONT VIEW

EMBODIMENT 3,
ONE-WAY CHECK VALVE
FLEXIBLE SEALED CONTAINER,
NON-THREADED PASSAGEWAY,

SEALED CONTAINER

ACTIVATED CONTAINER

RESTING CONTAINER

SQUEEZE PUMP
E-Z SQUEEZER

CONTAINER CAP
WITH FLEXIBLE TUBE AND SLIT VALVE
SEPARATE FROM PASSAGEWAY TUBE

CONTAINER CAP
WITH FLEXIBLE TUBE AND SLIT VALVE
COMBINED WITH PASSAGEWAY TUBE

STABLE UPRIGHT FLUID DISPENSING CONTAINERS

This application is based on and claims the benefit of U.S. Provisional Application Ser. No. 60/343,526, filed Dec. 31, 2001. The entire disclosure of this provisional application is relied upon and incorporated by reference herein.

BACKGROUND OF THE INVENTION

1. Field of the Invention

A new mechanism that dispenses fluids, especially highly viscous fluids, from a container, particularly upright containers, in an efficient and user friendly manner is disclosed. More particularly, the present invention provides fluid dispensing containers such that fluid is dispensed from the top of the containers while the bulk of the fluid always remains at the bottom of the container. This provides a container that is stable in an upright position and a container such that all the fluid contained therein is easily dispensed without problem.

2. Description of the Art

There are many containers on the market that dispense fluids or liquids, particularly those that are highly viscous such as shampoo, conditioner, lotions, toothpaste, ketchup, mustard, mayonnaise, etc. The procedure to dispense fluid from these conventional dispensing containers requires the user to turn the container up side down so that the fluid flows from the bottom of the container to the top of the container. The container is then squeezed and the fluid is dispensed through the exit opening on the top of the container. After dispensing the fluid, the container is then placed in the normal upright position and the fluid flows to the bottom of the container. When the fluid is dispensed for another time the fluid must be forced to the top of the container again prior to being dispensed, by turning the container upside down. This procedure is very inefficient and as the fluid volume decreases, this procedure requires more time and becomes even more difficult.

To remedy this situation manufacturers have provided an assortment of containers ranging from pump containers, plunger containers, and squeeze containers Many, particularly lotion containers, have a tube that is reaches to the bottom of a container. The person using the container merely squeezes or pushes on a pump to dispense the fluid. Some containers also include valves that are provided to prevent pressure build-up within the container. In squeeze type containers, the displaced air is replenished through the same exit tube by which the fluid is dispensed causing the fluid to be sucked out of the tube and back into the container after squeezing occurs.

The procedure to dispense fluid from conventional dispensing containers such as shampoo and other hair products, body lotions, and food products such as mustard, ketchup, and mayonnaise requires the user to turn the container up-side down so that the fluid flows from the bottom of the container to the top of the container. The container is then squeezed and the fluid is dispensed through the exit opening on the top of the container. After dispensing the fluid, the container is then placed in the normal upright position and the fluid flows to the bottom of the container. When fluid volume is low, this procedure requires more time and becomes more difficult.

Many containers are for toothpaste. Some include an all in one device. These include the toothpaste dispensing type in which a disposable cartridge is placed in the body of the toothbrush. Some designs feature a threaded rod and plunger in the handle to dispense toothpaste. The plunger in these types of devices works by forcing the toothpaste or other fluid from the bottom of the container up through the tube and out the top of the container. This makes the container top-heavy and unstable. When the fluid gets near the bottom of the container, the plunger or other device does not work to dispense the remaining fluid. This fluid becomes wasted or the container is turned upside down and the top must be removed to access the remaining fluid.

With respect to toothpaste containers and particularly toothbrush/toothpaste containers, once the toothpaste is consumed, the cartridge is disposed of and another cartridge is inserted. Thus, the toothbrush head gets more use than the normally recommended two to three months. Additionally, most toothbrushes have thin handles and are incapable of standing alone. They must use a device of some type, such as a toothbrush holder, to keep them upright.

Thus, there is a need for containers that dispense ALL of the fluid therein. With respect to a freestanding toothbrush, there is also a need for a toothbrush that is disposable, but which, past the recommended use, is unusable.

SUMMARY OF THE INVENTION

It is an object of the invention to provide a stable upright fluid dispensing container in which the fluid is dispensed from the top of the container while the bulk of the fluid remains on the bottom of the container and all the fluid therein is dispensed, thereby being less wasteful.

It is an object of the present invention to provide an ergonomically designed freestanding toothbrush.

It is another object of the present invention to provide a toothbrush having an S-curve tapered body.

It is a further object of the present invention to provide a toothbrush that dispenses toothpaste through exit holes in a head.

It is yet another object of the present invention to provide a toothbrush that is recyclable.

It is still another object of the present invention to provide a stable upright fluid dispensing container in which liquid within the container is dispensed from the top of the container while the container remains in an upright position, and the bulk of the fluid always remains in the bottom of the container, rendering the container stable.

It is yet another object of the present invention to provide a stable upright fluid dispensing container that includes a rotating threaded passageway tube and free non-rotating threaded plunger.

It is a further embodiment of the present invention to provide a stable upright fluid dispensing container that includes a non-rotating threaded passageway tube having a fixed plunger and a rotating threaded knob.

It is still a further embodiment of the present invention to provide a stable upright fluid dispensing container including a flexible sealed container and a non-threaded passageway tube with a one-way check valve.

These objects and advantages are obtained by providing a fluid dispensing container that includes a rotating threaded passageway tube and a free non-rotating threaded plunger, a non-rotating threaded passageway tube having a fixed plunger and a rotating threaded knob. Any type of knob can be used including a horizontal knob gear, a vertical knob gear or a push button rack gear. In addition, the flexible sealed container includes a non-threaded passageway tube and a one-way check valve. The check valve can have a slit.

The container of the present invention includes a body filled with fluid to be dispensed, a passageway open at the bottom of the body cavity extending to the exit opening at the top of the body container (this passageway can be on the side of the container or as a threaded or non-threaded tube in the center of the body cavity), and an activation system. The activation system is designed to apply pressure on the fluid in order to force the liquid up through the passageway in the lower end of the container and out the exit opening on the top of the container. The activation system can be for example, a rotating threaded tube and non-rotating plunger system, a non-rotating tube and non-rotating plunger, having a rotating knob system, an applied pressure, one-way check valve system and non-threaded tube system (no threaded tube or plunger, e.g., E-Z Squeeze), or other system that will perform this function.

The container can be a toothbrush containing toothpaste including a head having openings therein and bristles attached thereto, a neck attached to the head, a cavity therein and a curved body having a first portion attached to the neck and having a cavity therein containing a threaded rod and having a piston attached to the threaded rod at a second portion which is wider than the first portion, and a base attached to the curved body and including an actuator device attached to the piston for rotating the piston along the threaded rod. This allows the toothpaste to be expelled through the openings in the head. The toothbrush can be a self-standing toothbrush. The head contains first sets of bristles that are in clusters around the openings in the head and second sets of bristles adjacent to the first sets of bristles. The first sets of bristles direct the toothpaste out of the body.

The cavity extending from the body to the head of the toothbrush is filled with toothpaste. The curved body is formed of a flexible material that can be, for example, some type of polymer. The body has an indicator window therein. The threaded rod is flexible. The actuator forces a predetermined amount of toothpaste out of the body, through the neck, into the head and out through the bristles. The actuator locks after turning a predetermined amount. This type of fluid dispensing container can also include a non-rotating threaded passageway tube having a fixed plunger and a rotating threaded knob.

A method of the present invention includes dispensing toothpaste in a toothbrush, including the steps of rotating an actuator device for engaging a piston in a body of the toothbrush, moving the piston a predetermined amount up a threaded rod in a cavity in the body of the toothbrush, forcing the toothpaste in the cavity through a neck of the toothbrush and into a mead of the toothbrush, and forcing the toothpaste through holes in the head and out through bristle cluster attached to the head. The hole in the head can be self-sealing after a predetermined amount of toothpaste is forced through.

These features of the present invention provide the advantages of an increased pressure with in the container that will force fluid to flow into a passageway tube through an entrance opening and out of an exit opening. Once pressure is relaxed the fluid flow will stop and the fluid will remain in the passageway tube unlike prior art devices where the fluid will flow back out of the tube. This also allows all the fluid in the container to be used and thus, not wasted. With respect a disposable toothbrush container, it can be self-standing, recyclable and only the correct amount of toothpaste can be dispensed.

BRIEF DESCRIPTION OF THE DRAWINGS

FIG. 1. is a flow chart of the various embodiments of the stable upright fluid dispensing container according to the present invention.

FIGS. 2A–2C are illustrations of various views of the rotating threaded passageway tube and free non-rotating threaded plunger according to an embodiment of the stable upright fluid dispensing of the present invention;

FIGS. 3A–3C are illustrations of a non-rotating threaded passageway tube having a plunger fixed to a passageway tube and a free rotating threaded knob according to another embodiment of the stable upright fluid dispensing container of the present invention;

DESCRIPTION OF THE EMBODIMENTS

Figures 4, 4B:
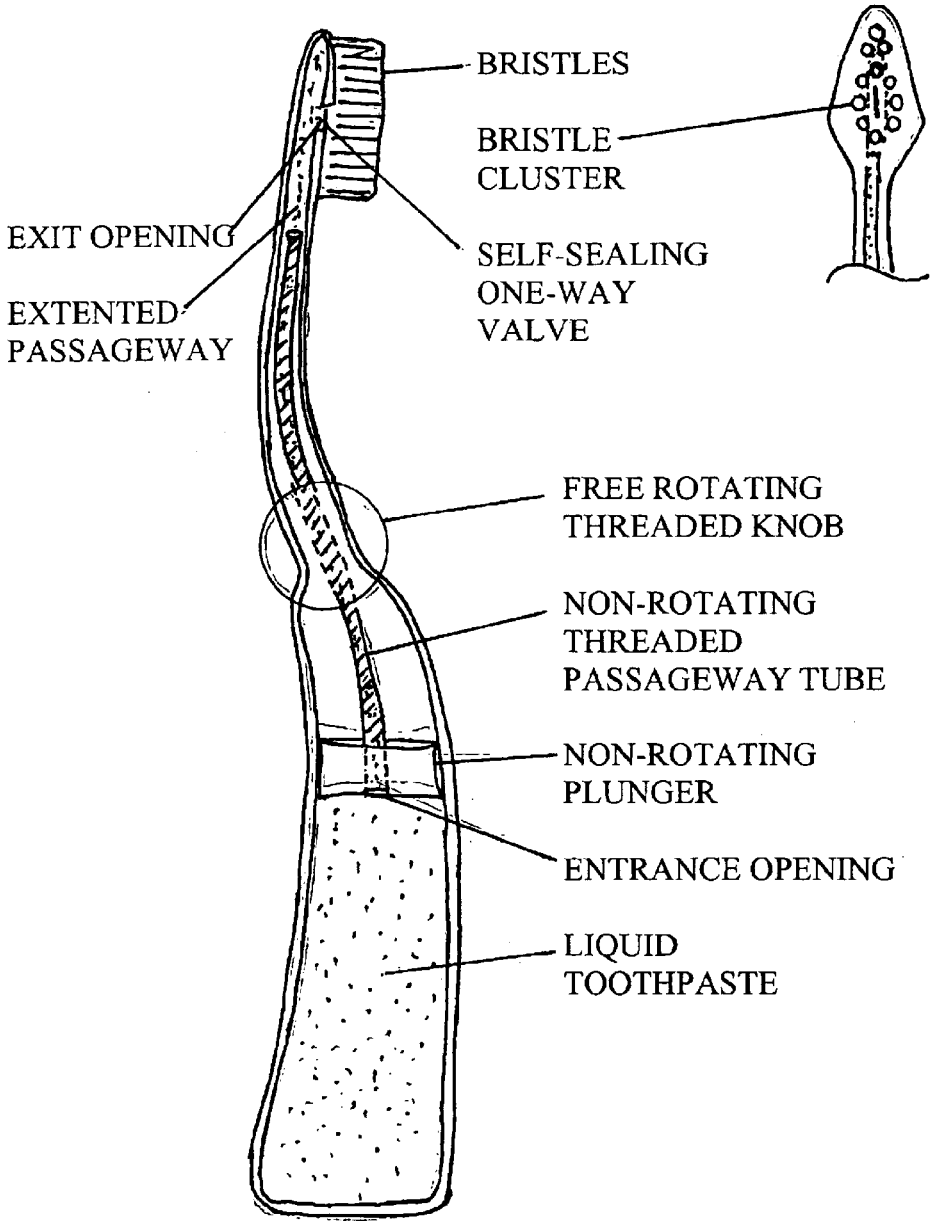
FIG. 4 is a drawing of a toothbrush using the embodiment of the stable upright fluid-dispensing container according to the present invention.

The following new containers have been invented in order to dispense fluids, especially high viscous fluids, from a container, especially an upright container, in an efficient and user-friendly manner. The uniqueness of these containers is that the fluid within the containers can be dispensed from the top of the containers while the bulk of the liquid always remains on the bottom of the container thereby making the containers stable in the upright position and able to dispense all the fluid therein.

The new containers eliminate the need to turn the container upside down in order for the fluid to flow to the top of the container when the fluid is almost all used. Instead, the container is always in the upright position, the user squeezes it, turns, or pushes a knob, and the fluid therein is dispensed. In the containers of the present invention, the liquid always remains on the bottom of the container making the container stable in the upright position. This improves the efficiency and ease at which the liquid is dispensed.

The containers of the present invention are designed to dispense a wide variety of fluids such as shampoo and other hair products, body lotions, and food products such as mustard, ketchup, and mayonnaise. The containers of the present invention are also able to dispense fluids in a controlled manner so that a required amount of fluid can be dispensed and recorded, such as in the recommended dose of fluoride toothpaste in the tooth care of children. In this case, even when it is recommended by professionals (Ad Hoc Subcommittee on Fluoride (1991) "Public Health Service Report on Fluoride Benefits and Risks" pg 6) to provide a regulating dose dispenser for fluoride toothpaste used by children, no such container is available at this time. The container of the present invention fulfills the requirements of fluoride treatments recommended by this report.

The new containers are easy and inexpensive to make and it is believed that they will be a significant improvement to existing fluid dispensing containers.

FIG. 1 is a flow chart of examples of the various types of containers and dispensing systems of the present invention.

FIGS. 2A–2C show first embodiment of the present invention includes a container that includes a rotating threaded passageway tube and a free non-rotating threaded plunger system within the container. The container includes a body filled with fluid to be dispensed and a plunger within the body cavity that forms a seal with the walls of the body cavity and the sides of the plunger. A key groove is provided that keeps the plunger in place. A threaded tube in the center of the body cavity is connected to the plunger.

The threaded tube has a passageway open at the lower end of the body cavity extending to the exit opening at the top of the container. This passageway can be on the side of the container or as a threaded tube in the center of the body cavity. Examples of the various configurations of the turning knob and gears designed to turn the threaded rod and push the attached plunger in a downward direction forcing the liquid through the threaded tube in the lower passageway and out the exit opening at the top of the container are shown, respectively in FIGS. 2A, 2B, and 2C. Exit openings and closures are designed for specific functions depending on the different types of exiting fluid.

Turning the threaded knob or gear pushes the keyed plunger down the body cavity thereby applying a pressure on the fluid within the cavity. This pressure forces the fluid up through the bottom of the threaded tube bottom passageway to the top of the container and out the exit opening. Fluid dispensed in this manner is always pushed from the top of the container to the bottom of the container. This keeps the center of gravity of the container as low as possible making a stable container. This type of container is more stable and easier to use compared to conventional containers where liquid must be transferred to the top of the container in order to be dispensed.

As shown in FIG. 2A, a turning knob rotates in a horizontal orientation either directly in relation to the threaded tube or connected by gears to the threaded passageway tube. The turning knob then rotates the threaded tube thereby pushing the plunger in a downward direction forcing the liquid through the lower passageway tube and out the exit opening at the top of the container.

As shown in FIG. 2B, a turning knob rotates in a vertical orientation and is connected to the threaded tube with gears. The gears are fixed to the passageway tube and rotate the threaded tube thereby pushing the plunger in a downward direction forcing the liquid through the passageway tube entrance opening and out the exit opening at the top of the container.

As shown in FIG. 2C, a spring-loaded button pushes a rack gear. The rack gear in turn rotates a gear attached to the threaded tube. The gear is attached to a flexible material and then to an external push button. When the push button is pushed, the gear attached to the flexible material, spring and threaded tube, rotates the threaded tube and thereby pushes the plunger in a downward direction forcing the liquid through the passageway tube entrance opening and out the exit opening at the top of the container.

FIG. 3 shows another embodiment of the present invention and includes a non rotating threaded passageway tube having a plunger fixed to the passageway tube and a free rotating threaded knob. This embodiment is used preferably for a toothbrush.

The container of this embodiment includes body filled with fluid to be dispensed, a non-rotating plunger within the body cavity that forms a seal with the walls of the body cavity and the sides of the plunger, a key groove that keeps the plunger in place and a non-rotating threaded tube in the center of the body cavity that is connected to the non-rotating plunger. A threaded passageway tube has an entrance that opens at the lower end of the body cavity and extends to the exit opening at the top of the container. This passageway tube can be on the side of the container or as a threaded tube in the center of the body cavity. An activation system includes a free rotating threaded knob that is threaded onto the threaded passageway tube in the body cavity. The threaded knob is rotated up the shaft and is then pushed in a downward direction to the original position. When the knob is pushed down the threaded passageway tube is also forced down thereby pushing the plunger in a downward direction forcing the liquid through the entrance of the threaded passageway tube and out the exit opening at the top of the container. The passageway tube does not rotate. Thus, the amount of liquid dispensed from the container can be precisely controlled by the rotations of the threaded knob and the diameter of the passageway.

Another method of dispensing the fluid in this embodiment includes continually rotating the threaded knob in a fixed spaced thereby pushing the threaded tube and plunger in a downward direction. This in turn forces the fluid up through the threaded tube and out through the exit opening.

In all of these embodiments exit openings and closures designed for specific functions of different types of exiting fluid are provided.

FIG. 4 shows embodiment of the present invention is an ergonomically designed toothbrush referred to as the "Tooth Buddy." The Tooth Buddy includes a head, a neck, a body and a base. The toothbrush has an S-curve shape so that it is self standing. The base of the toothbrush has a circular or semi-circular shape. The center axis passes through the center or as close to the center as possible. The base can be approximately one inch (1") long and approximately 1.5 inches in diameter for an adult size toothbrush. Of course, a youth toothbrush would be proportionally smaller. The base is the widest part of the toothbrush. This allows the toothbrush to stand upright.

The body of the toothbrush can be approximately 1.3 inches in diameter and is slightly tapered so that it has a smaller diameter than the base. The taper continues to decrease as it approaches the neck of the toothbrush where it has a diameter of approximately 0.5 inches. In this section, the center axis is offset to the center of the body. Providing the body with a shape that has a sweeping curve that crosses the center axis twice accomplishes this. The approximate length of the toothbrush body is the width of a hand. If it is an adult toothbrush, an approximate length is five inches (5") including the base. If it is a child/youth toothbrush, the approximate length is three inches (3") including the base.

The neck of the toothbrush is also offset to the center axis and is slightly curved in the opposite direction to the curve of the body, but never crosses the center axis. Rather, it approaches the center axis so that the head crosses the center. The length from a mouth opening to the beginning of back rear teeth determines the neck length. In an adult, this length is approximately 2.5 inches. In a child, this length is approximately 1.5 inches. The taper in the neck is greatest at the body end and becomes consistent at approximately 0.2 inches.

The head of the toothbrush is approximately one inch (1.0") in length, approximately 0.5 inches in height and approximately 0.5 inches in width. The head crosses the center axis such that bristles in the head are located on the center axis.

Because the toothbrush is located around the center axis, when the toothbrush is rotated, maximum movement occurs in the body of the toothbrush which is off center to the center axis and minimum movement occurs in the toothbrush head which is on the center of the center axis.

In practice, when switching from brushing the lower teeth to brushing the upper teeth, rotating the wrist of the hand holding the toothbrush rotates the toothbrush from one position to the other position. The curve of the toothbrush body allows for maximum movement of the wrist rotation while allowing only minimum movement of rotation of the toothbrush head within the mouth. This ergonomic design increases efficiency and comfort when brushing teeth.

The toothbrush of the present invention can also be a toothpaste-dispensing toothbrush as shown in FIG. 4. The toothpaste can be dispensed to bristles on the toothbrush head, through passageways in the neck and head of the toothbrush.

The toothpaste in the cavity of the toothbrush base is forced through the neck and into the head of the toothbrush. A plunger mechanism in the base of the toothbrush then forces the toothpaste out into bristle bundle clusters. The plunger mechanism includes a plunger piston, a plunger threaded platform and a threaded rod that is connected to an activation knob. Toothpaste is stored in the cavity in the toothbrush. When the activation knob is turned, the toothpaste is forced out of the cavity, through the toothbrush neck, into the toothbrush head, and out exit openings in the toothbrush head. When the activation knob is turned, the threaded rod is also turned and a threaded platform attached to the plunger piston advances up the threaded rod. The plunger platform applies pressure to the toothpaste and then forces it through the passageways in the neck and head of the toothbrush.

The head includes the bristle bundle clusters that include bundles of bristle that form a cluster and a passage way for directing the toothpaste out of the head. The bristle clusters encircle exit openings in the head. That is, several bristle bundle clusters surround an exit opening and are incorporated into the toothbrush head. The exit openings are the dark circles. The open circles illustrate the bristle bundles. The exit openings can also include a self-sealing cap. This prevents toothpaste from leaking out when the toothbrush is not in use.

Ideally, at least five bristle bundle clusters should surround each exit opening (for an adult toothbrush). Filler bristles surround the bristle bundles to fill in any empty spaces and in a manner that leads to efficient and thorough brushing. It should be noted that the exit openings, bristle bundles and filler bristles are not limited to the examples discussed above. Examples of various bristle bundle clusters and their arrangement on the head of a toothbrush will now be explained.

Four exit openings can be located on the toothbrush head. The exit openings can be located along the cavity in the four bristle cluster head. The four bristle bundle cluster toothbrush head is considered an adult size toothbrush.

A six bristle bundle cluster toothbrush head is also considered an adult size toothbrush. Two exit openings can be located along the main cavity that extends to the base of the toothbrush. Two other cavities can be provided in the toothbrush head and can extend perpendicular to the main cavity. In this example, an exit opening is located at each end of each cavity perpendicular to the main cavity.

The head of the toothbrush can be assembled in three sections plus the bristles. If these sections are put together, the toothbrush head of the present invention results. The number of bristles and bristle bundle clusters can vary.

The bristles can be approximately 10 mm high and the opening formed by the bristles, which extends from the exit opening to the top of the bristles, can be approximately 1 mm wide. The following Table 1 gives the approximate diameter, radius, etc., of the bristle bundle clusters and exit opening.

The volume of toothpaste in a bristle cluster varies with diameters of 0.6 mm, 0.8 and 1.0 mm, which hold respective volumes of toothpaste of 28 $\mu$l, 50 $\mu$l and 78 $\mu$l.

TABLE 1

| mm Diameter | mm radius | $r^2$ | mm Length | vol (i l) $\delta r^2 l$ |
|---|---|---|---|---|
| 1.0 | 0.5 | 0.25 | 10 | 78 |
| 0.8 | 0.4 | 0.16 | 10 | 50 |
| 0.6 | 0.3 | 0.09 | 10 | 28 |

The volume of toothpaste per brushing with respect to varying number of bristle bundle clusters and the diameter of the bristle bundle clusters is shown in Table 2.

TABLE 2

| Number of Clusters | Diameter 0.6 | Diameter 0.8 | Diameter 1.0 |
|---|---|---|---|
| 2 | 56 | 100 | 156 |
| 3 | 84 | 150 | 234 |
| 4 | 112 (y) | 200 | 312 |
| 5 | 140 (4) | 250 | 390 |
| 6 | 168 (A) | 300 | 468 |

For example, the toothpaste volume for a youth should be approximately 125 $\mu$l and for an adult should be approximately 250 $\mu$l. Table 2 allows one to determine the optimum number of clusters and their diameter. Thus, a predetermined amount of toothpaste is dispensed for each brushing. This ensures that too much toothpaste and fluoride are not used.

As the toothpaste is dispensed through the exit openings, the clusters of bristle bundles act as an extended passageway keeping the toothpaste within the bristle bundle cluster. Because all the toothpaste dispensed will be in close proximity to the bristle bundle clusters, the toothpaste dispensing process and brushing procedure are efficient and effective. The volume of toothpaste per brushing to be dispensed for adults or youth is shown in Table 3.

TABLE 3

| | i l/Brushing | Brushing/Day | | mm Total Volume |
|---|---|---|---|---|
| ADULT | 250 | 3 | 90 | 67.5 |
| YOUTH | 125 | 3 | 90 | 33.8 |

For example, 250 $\mu$l and 125 $\mu$l at three brushings a day for three months (ninety days) uses a total volume of 67 ml and 33 ml of toothpaste, respectively.

The threaded rod is flexible and the plunger piston is adjustable to accommodate the S-curve shape and taper of the toothbrush cavity.

TABLE 4

| | | % used vol / Total vol | | | |
|---|---|---|---|---|---|
| | Clusters | .8 | | 1.0 | |
| Youth | 3 | 125 / 150 | 83 | 125 / 234 | 53 |

TABLE 4-continued

| | Clusters | % used vol / Total vol .8 | | 1.0 | |
|---|---|---|---|---|---|
| Adult | 6 | 250 | 83 | 250 | 53 |
| | | 300 | | 468 | |
| Youth | 2 | 125 | 125 | 125 | 80 |
| | | 100 | | 156 | |
| Adult | 4 | 250 | 125 | 250 | 80 |
| | | 200 | | 312 | |

The activation platform and plunger are kept from rotating after a plunger retainer guide has dispensed the predetermined amount of toothpaste. The activation knob can only be turned in one direction. This is achieved by providing ratchet teeth on the activation knob. The ratchet teeth engage ratchet stops attached to the toothbrush body. A mechanism can be provided, particularly on the youth toothbrushes, that will allow reactivation of the activation knob by, for example, lifting it over a hindering or locking device or some other child safety type mechanism. This would prevent a child from continuously turning the knob and discharging all the toothpaste.

An indicator window, which is made of, for example, a clear plastic, is located on the side of the toothpaste body. This allows viewing of how much toothpaste remains in the toothpaste body.

The exterior of the toothbrush body can include grooved non-slip body grips, for example, or any other type of gripping aid to aid in holding the toothbrush. These grips or aids would also assist in drainage after brushing and cleaning the toothbrush.

The toothbrush can be a one-piece construction. This allows for a finite amount of brushings. After the toothpaste is used, the toothbrush becomes disposable. The toothbrush can also be made from recyclable material. This insures that the toothbrush will have to be replaced after a certain number of brushings.

Figures 5A, 5B, 5C:
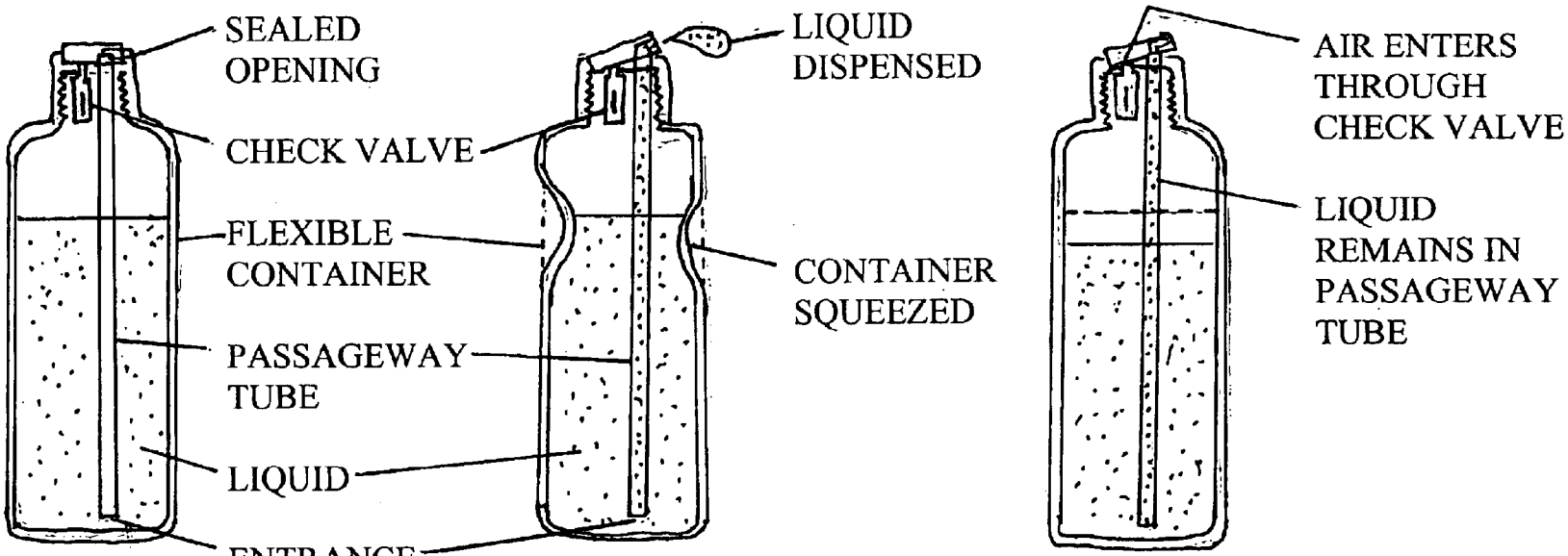
FIGS. 5A–5C are illustrations of a flexible sealed-container having a non-threaded passageway tube and flexible tube with check valve according to yet another embodiment of the stable upright fluid dispensing container of the present invention.

FIG. 5 shows a flexible sealed container having a non-threaded passageway tube and a flexible tube with a one-way slit-valve (FTS—rubber tube with slit check valve) according to the present invention. There is no threaded shaft or plunger.

The container of this embodiment includes container of fluid to be dispensed, a container that is made of squeezable material and a sealed cap on the top of the container that can open and close. The sealed cap can be, for example, a screw cap with a flip open/close seal, but any type of cap can be used. A passageway tube is connected to the cap opening. The passageway tube extends from the top of the container to the bottom of the container, and is open on the lower end of the body cavity. A one-way check valve, which includes a rubber tube and slit check valve, is located on the upper portion of the container. The check valve can be located within the cap area or directly on the tube. The check valve allows air into the container but does not allow air out of the container.

When the cap is in the open position and pressure is applied to the main body of the container by squeezing the container, the fluid within the container is forced into the tube passageway at the bottom of the body cavity. The fluid will is then forced up through the tube passageway and out of the exit opening on the top of the container. When the pressure is relieved, the container resumes its original shape by drawing in air through the one-way check valve. A viscous fluid will remain in the passageway and can be immediately dispensed again by applying more pressure to the main body of the container in the same manner. Closing the cap can also seal the one-way check valve.

Figure 6:
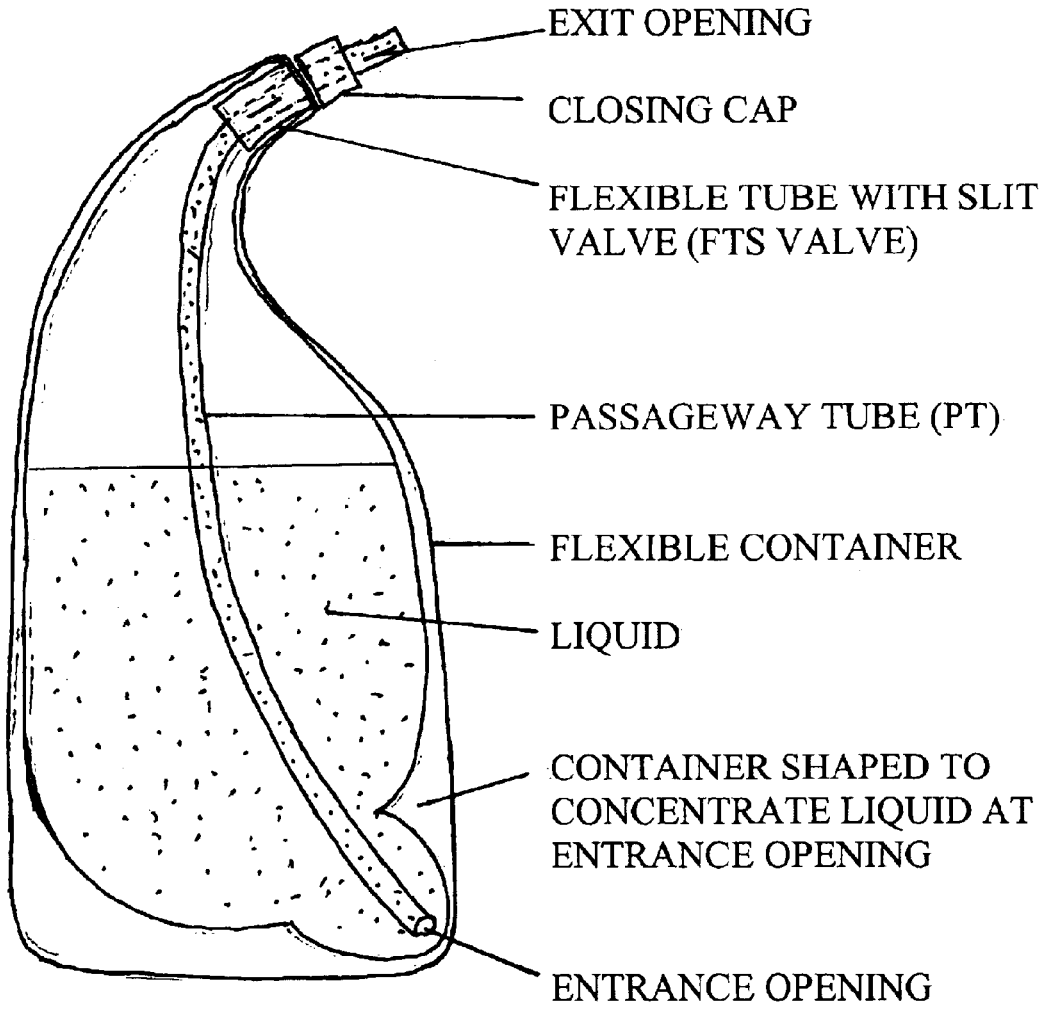
FIG. 6 is a drawing of a squeeze pump type bottle according to the stable upright fluid dispensing container of the present invention.

FIG. 6 shows an embodiment of a container in which the FTS valve is part of, or is connected to the passageway tube. The flexible container body can also be any shape. The container can include a shape that concentrates the fluid in the passageway tube entrance at the bottom of the container.

Figures 7A, 7B:
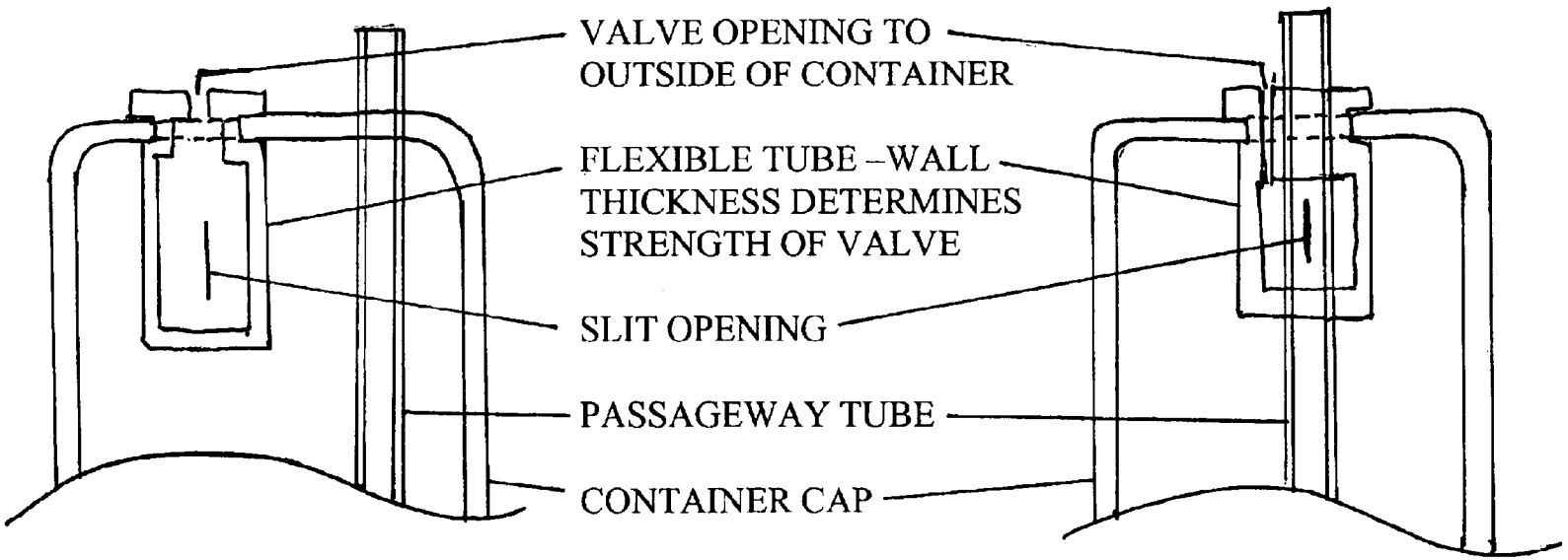
FIG. 7 is a drawing of a flexible tube having a slit (FTS) valve according to the stable upright fluid-dispensing container of the present invention.

FIG. 7 shows two configurations for the FTS valve (shown in FIGS. 5 and 6), however, any configuration that will obtain the same purpose can be used.

The check valve can also include a rubber tube and slit check valve. The design of the check valve insures that it will not clog when it comes in contact with the fluid. The valve can be made of a plastic rubber tube sealed on one end, and a slit in the body of the tube. The open end of the tube is sealed to the inside of the container cap so that air can enter the container from the outside of the container through the slit in the rubber tube. When the container is squeezed and pressure is applied to the container the slit closes from the pressure and the pressure is forced onto the fluid and the liquid is then forced up the tube and out the exit opening. When the squeezing stops, the container body relaxes to its original position. In doing so, air from outside the container will be sucked into the container through the slit. Thus, the name rubber tube and slit check valve.

The rubber tube and slit check valve can be placed, for example, on top of the container where it needs its own opening. It can also be attached to the exit of the passageway tube where only one opening is needed.

The container of any of the embodiments can have any shape that will hold the fluid therein in a confined area above the tube opening on the bottom of the container. This maximizes the dispensing of the low volume last remaining liquid The embodiments set forth above employ various exit opening and closure systems.

It should be noted that any type of exit opening and closure system can be employed that will give the desired results.

Having now fully described the invention, it will be appreciated by those skilled in the art that the invention can be performed within a range of equivalents and conditions without departing from the spirit and scope of the invention and without undue experimentation. In addition, while the invention has been described in light of certain embodiments and examples, the inventor believes that it is capable of further modifications. This application is intended to cover any variations, uses, or adaptations of the invention which follow the general principles set forth above.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A stable fluid dispensing container comprising:

a body cavity within said stable fluid dispensing container, said body cavity filled with fluid to be dispensed;

a plunger within said body cavity forming a seal with walls of said body cavity and sides of said plunger;

a key groove keeping said plunger in place;

a threaded passageway tube within said body cavity and having an opening at a lower end of said threaded passageway tube, said threaded passageway tube having said plunger connected thereto at said lower end, and extending to an exit opening at the top of said container; and a free turning knob, operatively connected to said threaded passageway tube, said free turning knob rotating in a horizontal orientation directly on said threaded passageway tube, said free turning knob rotating up said threaded passageway tube, and then pushed in a downward direction on said threaded passageway tube thereby pushing said plunger in a downward direction and forcing said fluid up through a lower portion of said threaded passageway tube and out said exit opening at the top of said container.

2. A stable fluid dispensing container according to claim 1, wherein said threaded passageway tube is on the side of said container.

3. A stable fluid dispensing container according to claim 1, further comprising an extended passageway attached to the top of said body cavity, wherein said threaded passageway tube is a threaded tube in the center of said body cavity, said threaded passageway tube being flexible and extending from said body cavity and into said extended passageway.

4. A stable fluid dispensing container according to claim 3, wherein said extended passageway is curved.

5. A stable fluid dispensing container according to claim 3, further comprising a connecting support means for connecting said extended passageway and said body cavity, said connecting support structure having a second portion wider than the first portion for housing said free rotating knob and said connecting support means creating an opening between said extended passageway and said body cavity.

* * * * *